US005375497A

United States Patent [19]

Pirchio et al.

[11] Patent Number: 5,375,497

[45] Date of Patent: Dec. 27, 1994

[54] ADJUSTABLE INSTRUMENT STAND

[75] Inventors: Paolo Pirchio, Casteldisardo; Mario Malizia, Castelfidardo, both of Italy

[73] Assignees: TAM SRL, Italy; Music Industries Inc., Floral Park, N.Y.

[21] Appl. No.: 984,292

[22] Filed: Nov. 30, 1992

[51] Int. Cl.[5] ..... G10D 3/00

[52] U.S. Cl. ..... 84/327; 84/453; 248/443

[58] Field of Search ..... 84/327, 453; 248/443

[56] References Cited

U.S. PATENT DOCUMENTS

| | | | |
|---|---|---|---|
| 1,612,148 | 12/1926 | Oettinger | 84/327 |
| 1,673,205 | 6/1928 | Romao | 84/327 |
| 1,684,912 | 9/1928 | Dunklau | 84/327 |
| 3,958,786 | 5/1976 | Mann | 84/327 |
| 4,352,480 | 10/1982 | Gathright | 84/327 |
| 4,582,282 | 4/1986 | Gracie | 84/327 |
| 4,693,161 | 9/1987 | Uhrig | 84/327 |
| 4,943,021 | 7/1990 | Cien et al. | 84/327 |

*Primary Examiner*—Michael L. Gellner
*Assistant Examiner*—Cassandra C. Spyrou
*Attorney, Agent, or Firm*—Amster, Rothstein & Ebenstein

[57] ABSTRACT

An adjustable portable stand, for supporting an elongate instrument (such as a guitar) by its base in a generally upright orientation, includes a multileg assembly including at least first and second vertically extending rigid legs disposed at a relative angle. First and second supports project outwardly from the first and second legs, respectively, for cooperatively supporting the base of an elongated instrument thereon, each of the supports being independently adjustable along the longitudinal axis of its respective leg and fixable at a selected point therealong. The supports are independently adjustable in height relative to the assembly to compensate for any bilateral asymmetry in the instrument base and thereby cooperatively maintain the instrument in a generally upright orientation.

5 Claims, 5 Drawing Sheets

ADJUSTABLE INSTRUMENT STAND

BACKGROUND OF THE INVENTION

The present invention relates to an adjustable portable stand for supporting an elongate instrument (such as a guitar) by its base in a generally upright orientation, and in particular to such a stand which compensates for any bilateral asymmetry in the instrument base so as to maintain the instrument in a generally upright orientation.

Portable stands for supporting an elongated musical instrument by its base in a generally upright orientation are well known in the art. Where the instrument is a guitar, bass or the like, the stand supports the elongate instrument in a generally upright orientation with its longitudinal axis generally vertical. On the other hand, where the instrument is a keyboard, xylophone or the like, the stand maintains the elongate instrument in a generally upright orientation with its longitudinal axis generally horizontal.

Typically, the stand comprises a multileg assembly including at least first and second vertically extending rigid legs disposed at a relative angle, with supports projecting outwardly from each of the legs for cooperatively supporting the base of the elongated instrument thereon. The multileg assembly may be either tripod-like, in which case there is also a third vertically extending rigid leg. Typically, the tripod-like multileg assembly is movable between a storage configuration, wherein all the legs extend generally parallel to one another, and a use configuration wherein all the legs extend at an angle to one another so as to provide a stable support for an instrument. Alternatively, the multileg assembly may include only the first and second legs disposed at a relative angle, with each of the legs having disposed at the free end thereof, opposite the junction of the legs, a stabilizing foot member extending transverse to a plane defined by both of the legs, thereby to provide a stable base for the assembly.

While such portable stands perform satisfactorily when used to support the more conventional instruments having a bilaterally symmetrical base—that is, a base or bottom end which is either symmetrical about its vertical longitudinal axis (like a violin) or flat (like a conventional keyboard)—they have not proven to be entirely satisfactory for use in conjunction with some of the newer instruments, and in particular the newer electrical instruments. As will be readily appreciated by those in the music industry, the latest electrical guitars frequently have a base or bottom end which is highly bilaterally asymmetrical, one side of the base extending greatly below the other side of the base. Keyboards also may have bases or bottoms which are not flat. When a conventional stand is used to support such a guitar, the longitudinal axis may be sharply tilted laterally to one side or the other and, depending upon the particulars of the instrument and the stand, the instrument may not be securely retained by the stand and there may even be a tendency for the stand and instrument as a unit to tip over. In the case of a keyboard intended to be played in a horizontal orientation, an asymmetrical base may result in the upper surface of the instrument being supported by the stand in a non-horizontal, tilted orientation unsuitable for playing thereof.

Accordingly, it is an object of the present invention to provide an adjustable portable stand for supporting an elongate instrument by its base in a generally upright orientation.

Another object is to provide such a stand in which the supports are independently adjustable in height relative to the assembly to compensate for any bilateral asymmetry in the instrument base and thereby cooperatively maintain the instrument in a generally upright orientation.

A further object is to provide such a stand which protects the instrument in the event that the stand falls forwardly in the direction of the instrument.

It is also an object of the present invention to provide such a stand which is easy and inexpensive to manufacture and maintain.

SUMMARY OF THE INVENTION

The above and related objects and features of the present invention are obtained in an adjustable portable stand for supporting an elongate instrument by its base in a generally upright orientation. The stand comprises a multileg assembly including at least first and second vertically extending rigid legs disposed at a relative angle and functionally joined at a junction. First and second supports project forwardly from the first and second legs, respectively, for cooperatively supporting the base of an elongated instrument thereon, each of the supports being independently adjustable along the longitudinal axis of its respective leg and fixable at a selected point therealong. The supports are independently adjustable in height relative to the assembly to compensate for any bilateral asymmetry in the instrument base and thereby cooperatively maintain the instrument in a generally upright orientation.

In a preferred embodiment, the stand includes means disposed generally at the functional junction of the legs for enabling manual variation of the relative angle, the enabling means enabling movement of the first and second legs to a non-parallel orientation for use of the stand and a parallel orientation for storage of the stand. Each of the supports is at least vertically curved and defines a recess adapted to accept the instrument base. The supports preferably differ in configuration and dimensions. Each of the supports is independently pivotable relative to its respective leg about an axis transverse thereto, and fixable in a given pivot orientation relative to its respective leg so that each of the supports is independently adjustable and fixable, both vertically and pivotally. Each of the first and second supports is disposed intermediate the free end of its respective leg and the functional junction of its respective leg and the other of the legs.

Preferably, the stand additionally includes receiving means for releasably receiving and supporting the end portion of the instrument opposite the instrument base. The receiving means is disposed above and forwardly of the functional junction of the legs and is mounted on a longitudinally extending arm, the arm being mounted on the functional junction and adjustable in height relative thereto, whereby the receiving means is adjustable in height. The arm is tilted at an angle to the vertical so that the forward projection of the receiving means is a function of its height relative to the functional junction of the legs. Each of the supports and the receiving means extends forwardly a distance greater than the thickness of the instrument disposed on the stand, whereby the stand protects the instrument in the event that the stand falls forwardly in the direction of the instrument.

Optionally, each of the legs has disposed at the free end thereof, opposed to the end at the junction of the legs, a stabilizing foot member extending transverse to a plane defined by both of the legs.

The present invention also encompasses the combination of such a stand and an elongate instrument having a bilaterally asymmetrical base. In the combination, each of the supports is fixed at a selected point along the length of its respective leg such that the supports cooperatively maintain the instrument in a generally upright orientation without lateral tilting due to the bilateral asymmetry of the instrument base. The instrument is preferably a musical instrument, such as a guitar.

BRIEF DESCRIPTION OF THE DRAWINGS

The above and related objects, features and advantages of the present invention will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENT

Figure 1:
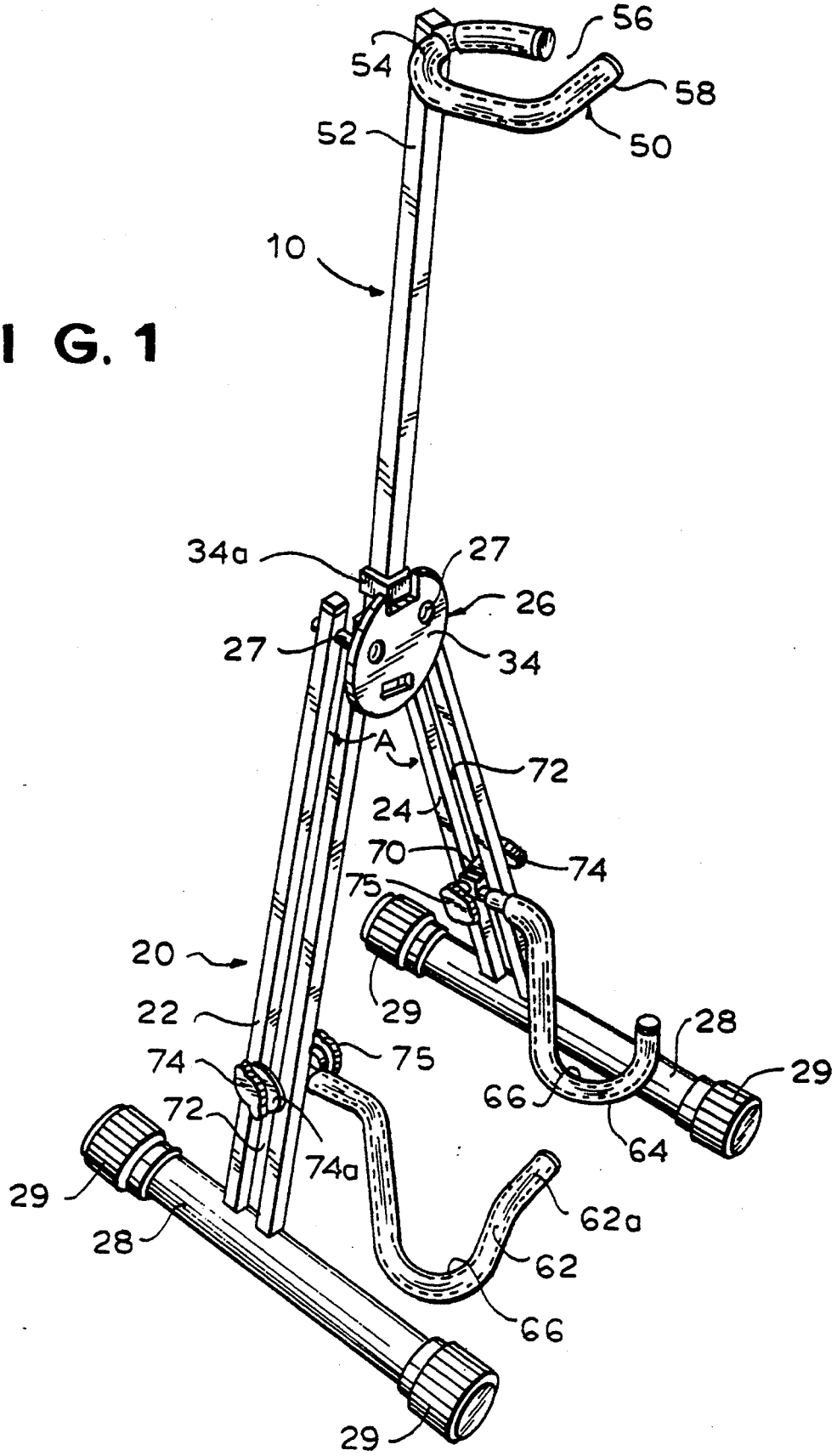
FIGS. 1 and 2 are front and rear isometric views, respectively, of an adjustable stand according to the present invention in an extended or use orientation, with an instrument being illustrated thereon in phantom line.
Figure 2:
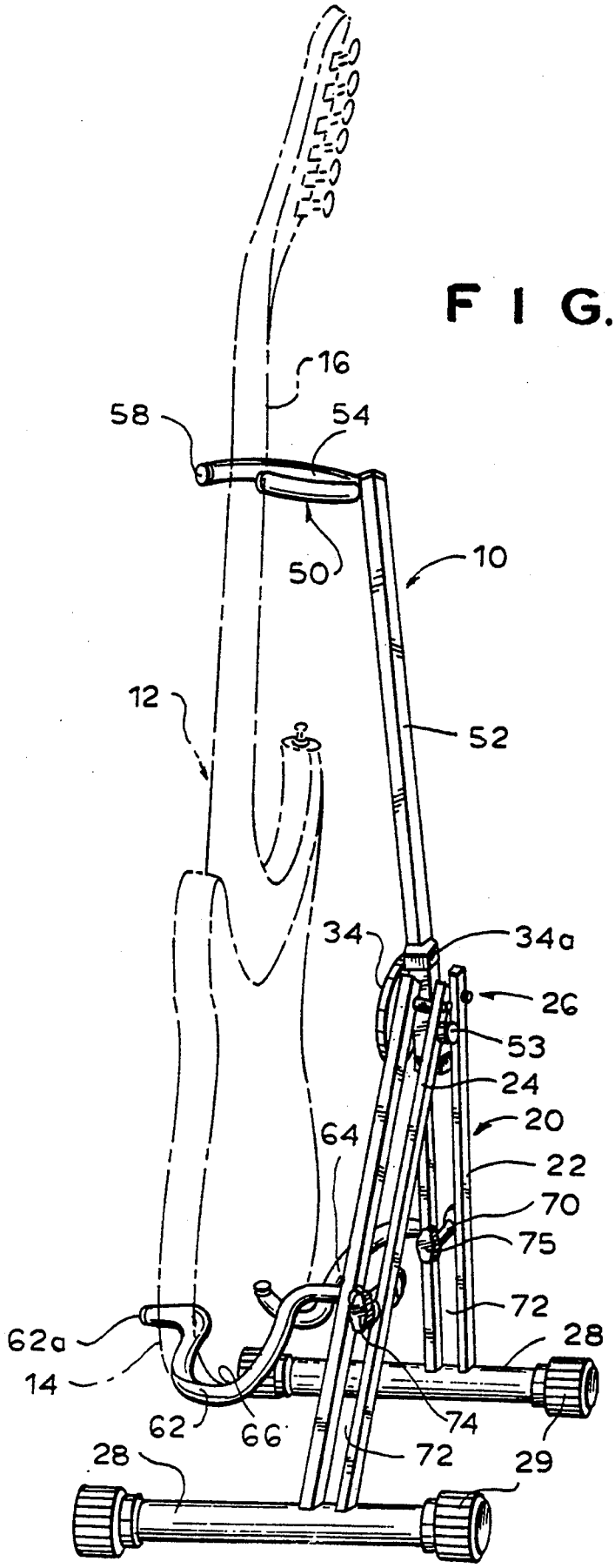
Figure 3:
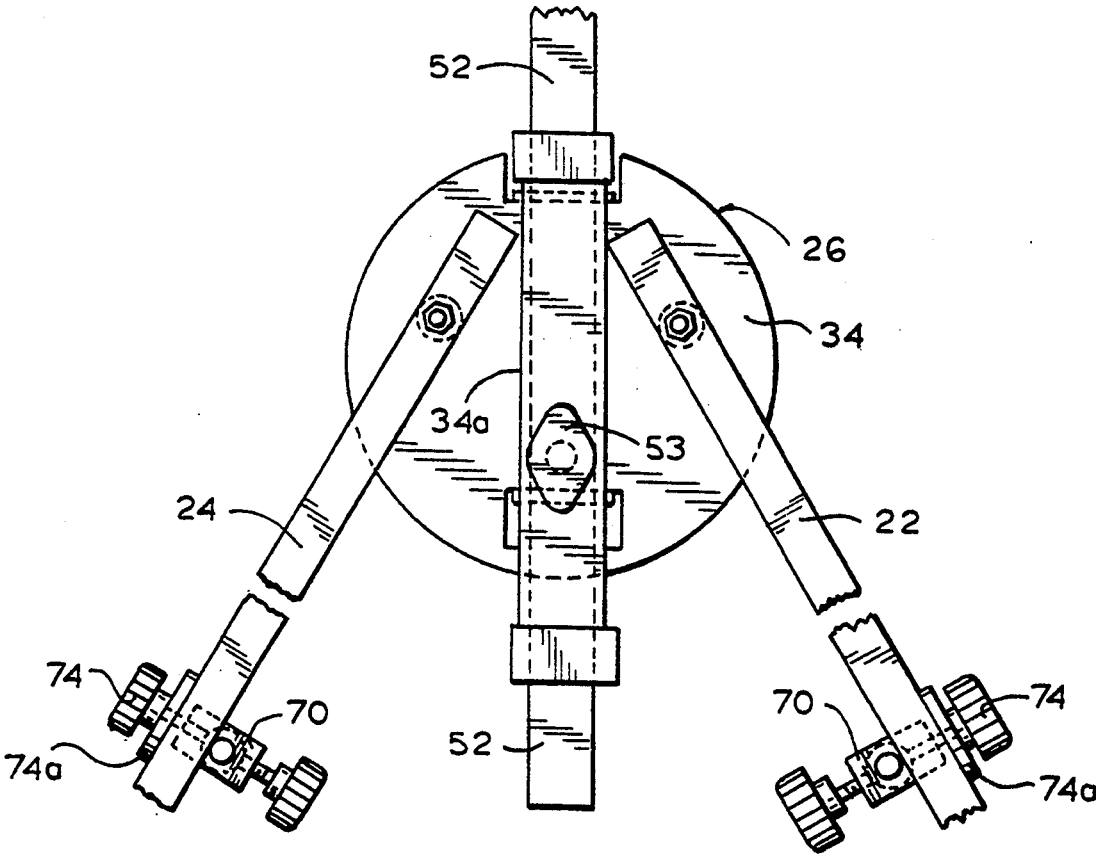
FIGS. 3, 4 and 5 are fragmentary rear elevational, bottom plan and side elevational views, respectively, of the stand, each to an enlarged scale.
Figure 4:
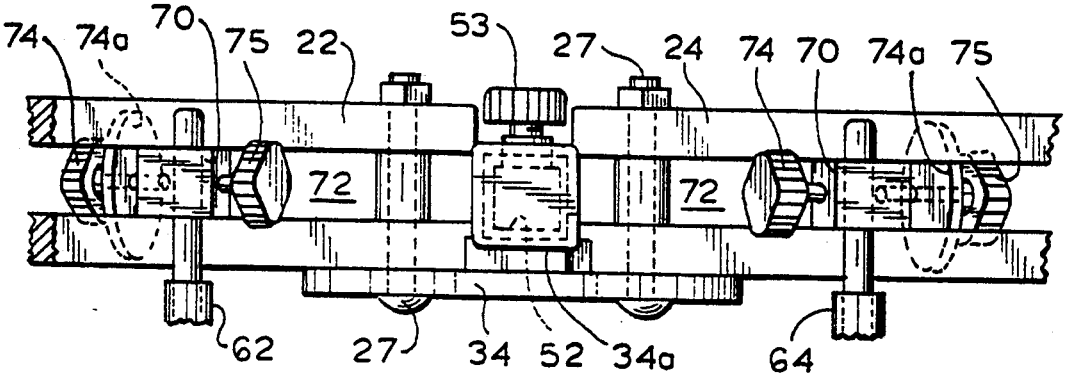

Referring now to the drawing, and in particular to FIGS. 1 and 2 thereof, therein illustrated is an adjustable portable stand according to the present invention, generally designated by the reference numeral 10. The stand 10 is intended to support an elongated instrument, generally designated 12, in a generally upright orientation, as illustrated in phantom line. The illustrated instrument is an electric guitar having a base or bottom 14 at one end of its longitudinal or elongate axis (adjacent the sound box) and a fingering end 16 at the other end of its longitudinal or elongate axis (adjacent the neck). While the description below of stand 10 will be in terms of a guitar 12 being supported therein, other instruments may similarly be supported by the stand in a generally upright orientation. For example, an elongate keyboard may be supported in an upright orientation with its upper surface generally horizontal, notwithstanding a bilateral asymmetry in its base or bottom. The only significant difference in the musical instruments mentioned (that is, the guitar or base vis-a-vis the keyboard or xylophone) is whether the elongate longitudinal axis is maintained generally vertically or generally horizontally by the stand 10.

More particularly, the stand 10 comprises a multileg assembly 20 including at least a first vertically extending rigid leg 22 and a second vertically extending rigid leg 24, the legs 22, 24 being disposed at a relative angle A. Means generally designated 26 are disposed generally at the functional junction of the legs 22, 24 for enabling manual variation of the relative angle, each leg 22, 24 being secured thereto by means of a separate pivot pin 27. In order to stabilize the free or floor end of the legs 22, 24 so that the stand 10 does not easily tip over either forwardly or backwardly, a transverse foot 28 is provided at the free or floor end of each leg 22, 24. As a guitar or bass is typically played at least at a slight angle to the vertical, tipping backwardly, the legs 22, 24 are tilted rearwardly relative to their transverse feet 28. Additionally, since the weight of the instrument is typically disposed towards the front of the stand 10, by way of compensation the legs 22, 24 are disposed somewhat rearwardly of the center or middle points of their respective feet 28. The feet 28 may be provided with rubberized caps 29 at each end thereof in order to increase their friction with the floor and simultaneously minimize damage to the floor.

A variety of enabling means 26 may be used in order to enable manual variation of the relative angle of legs 22, 24. In the preferred fixing means illustrated, each leg 22, 24 is pivotally secured to a disk 34 which serves as the functional junction of legs 22, 24. The different relative angles of the legs 22, 24 play a role in determining the height of the instrument 12 supported by the stand 10.

In a preferred embodiment of the present invention, particularly suitable for a guitar or like instrument having an extended neck 16 of reduced cross section (as opposed to a keyboard or xylophone), receiving means generally designated 50 are provided for releasably receiving and supporting the neck or upper end portion 16 of the instrument. Receiving means 50 is typically disposed appreciably above the enabling means 26, at the upper end of an elongate, longitudinally extending arm 52. The receiving means 50 is generally formed as a U- or C-shaped grip 54 defining an opening 56 through which the neck 16 of the instrument may pass. Preferably, the grip 54 is oriented so that gravity tends to maintain the instrument neck 16 within the grip 54 when the stand is in use. It will be appreciated that, for reasons to be set forth hereinafter, a portion 58 of the grip 54 is disposed in front of the face or front of the instrument end portion 16. The grip 54 is preferably formed of metal with a soft or rubber-like covering thereover to protect the instrument therefrom.

Figure 5:
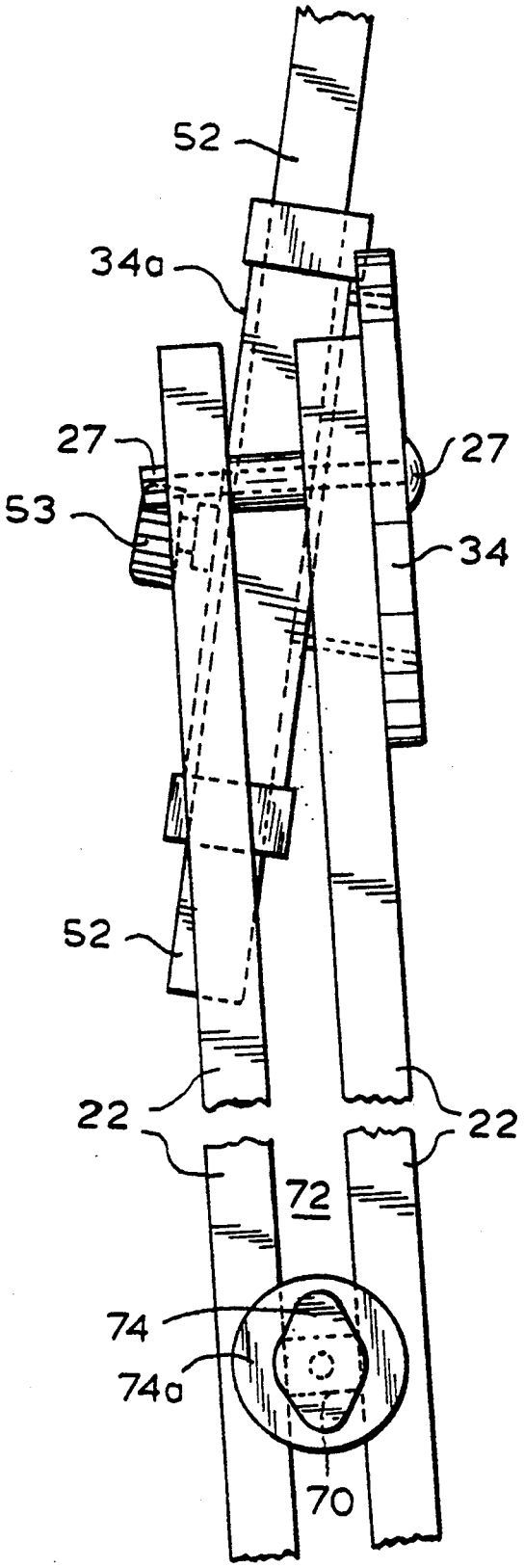
Figure 6:
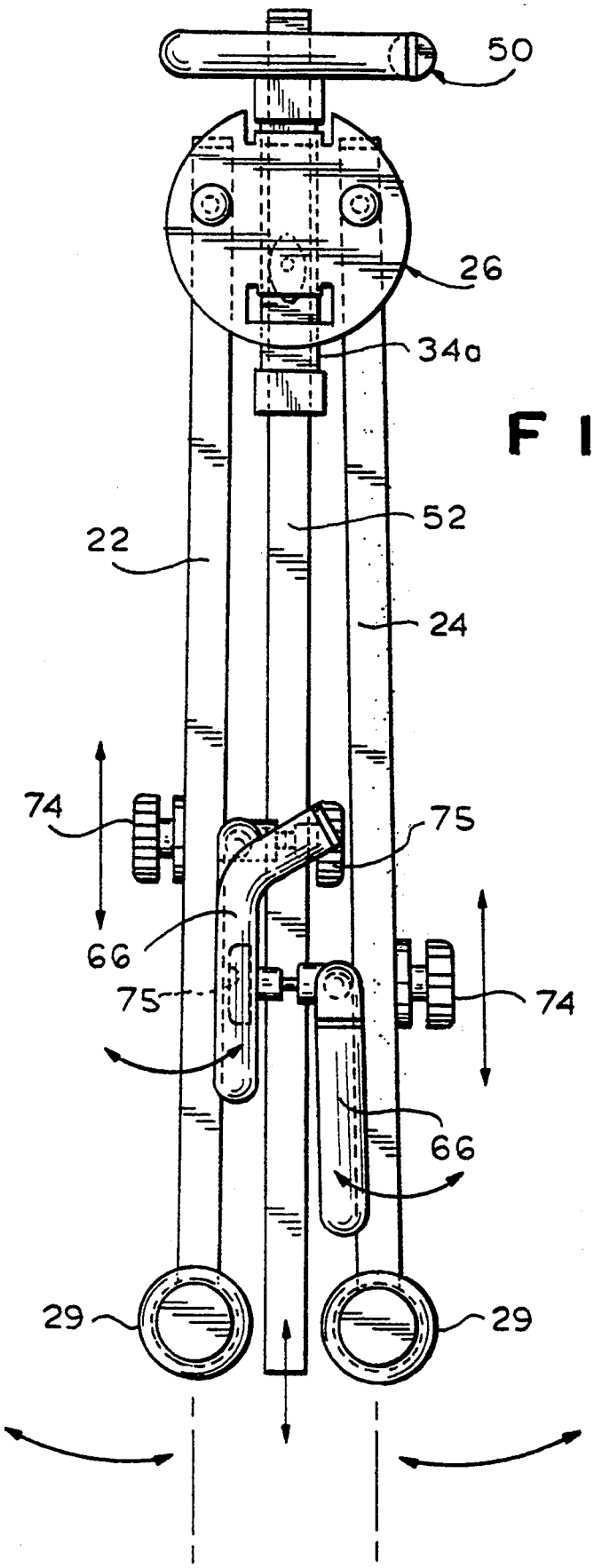
FIG. 6 is a front elevational view of the stand in a collapsed or storage orientation.

Preferably, the arm 52 supporting receiving means 50 passes generally vertically through a bracket **34*a* behind disk 34 and is slidable relative to the fixing means 26 along a generally vertical axis so that the receiving means 50 may be moved between a collapsed or storage position, wherein the grip 54 is closely disposed above the enabling means 26, as illustrated in FIG. 6, and an extended or use position wherein the grip 54 is appreciably spaced above the enabling means 26, as illustrated in FIGS. 1 and 2. The position of the arm 52 relative to the enabling means 26 is preferably mechanically fixable by a set screw knob 53 passing through bracket 34*a*. Ideally, the receiving means 50 not only moves between a collapsed position for storage and an extended position for use, but also to various intermediate positions (between the fully extended and collapsed positions) for adjustment to the particular length of a given instrument 12. Preferably, the arm 52 is slightly tilted to the vertical (i.e., upwardly and forwardly as best illustrated in FIG. 5) so that the higher the receiving mean 50 relative to bracket 34*a* at the junction of legs 22, 24, the further forward it projects relative to the enabling means 26**.

A first support 62 projects forwardly from first leg 22, and a second support 64 projects forwardly from second leg 24. Each of the supports 62, 64 is disposed intermediate the enabling means 26 and the free or bottom end of its respective leg 22, 24. Each of the supports 62, 64 has a forwardly projecting end which is at least vertically curved and defines a recess 66 adapted to accept a portion of the instrument base 14. The first and second supports 62, 64 cooperatively support the base 14 of the instrument 12 thereon. The supports 62, 64 are preferably formed of metal covered with rubber or other soft cushioning material in order to protect the instrument 12 therefrom.

As is apparent from inspection of FIG. 1, the front ends of the supports 62, 64 extend in front of the base or bottom 14 of the instrument 12, while the front of the grip 58 of the receiving means 50 extends in front of the neck or end portion 16 thereof. Accordingly, in the event that the stand 10 is accidentally tipped over forwardly, in the direction of the instrument 12, the padded or cushioned front ends of supports 62, 64 and the padded or cushioned portion 58 of receiving means 50 act as protective elements to at least partially absorb the shock of impact and protect the instrument 12 from contact with the floor.

Turning now to the novel aspects of the present invention, each of the supports 62, 64 is independently adjustable along the longitudinal axis of its respective leg 22, 24 and fixable at a selected point therealong by means of an engaging mechanism. The engaging mechanism comprises a base 70 which receives therethrough the back end of a respective support 62, 64 and itself extends through a vertically extending channel or slot 72 running substantially the longitudinal length of the legs 22, 24. The base 70 is slidable along the slot 72 so as to permit the support 62, 64 to be adjustable in height along the length of its respective leg 22, 24. Means, such as a set screw knob 74, are threaded through the outer side of each base 70 for causing a washer **74*a* to engage the respective leg 22, 24 and thus fixing the position of the base 70, and hence the entire support 62, 64, along the length of its respective longitudinal leg slot 72. It will be appreciated that the adjustability of the supports 62, 64 along the longitudinal axes of their respective legs 22, 24** is continuous in the preferred embodiment illustrated, although, if desired, a different mechanism for providing the adjustability and fixation of the supports on their respective legs may be provided which enables only a plurality of discrete fixation points.

Thus, the supports 62, 64 are independently adjustable in height relative to the assembly 20 to compensate for any bilateral asymmetry in the instrument base 14 and therefore to cooperatively maintain the instrument 12 in a generally upright orientation. Accordingly, as illustrated in FIG. 1 in particular, where an elongate instrument 12 has a bilaterally asymmetrical base, each of the supports 62, 64 may be independently fixed at a selected point along the length of its respective leg 22, 24 such that the supports 62, 64 cooperatively maintain the instrument 12 in a generally upright orientation without lateral tilting due to the bilateral asymmetry of the instrument base 14.

In a preferred embodiment of the present invention, the back end of each support 62, 64 passing through its respective base 70 is pivotable relative to the base 70 (and hence its respective leg 22, 24) so that the supports 62, 64 are independently adjustable both vertically and pivotally. Means, such as a set screw knob 75, are threaded through the inner side of each base 70 for engaging the support back end and thus fixing the orientation to which the support has been pivoted. The pivotal adjustability of the supports 62, 64 enables them to be disposed in such a manner as to more securely grasp irregularly contoured instrument bases as the recesses 66 defined by supports 62, 64 are not limited to being exclusively vertical in orientation, but are pivotable into separate planes which are non-parallel to the vertical.

The supports 62, 64 may be of like configuration and dimensions. However, preferably the supports 62, 64 differ in configuration and dimensions with support 62 having a forward tip **62*a* which normally extends slightly upwardly and laterally (towards the other support 64) so as to further assist in retention of the instrument base on the stand 10**.

In order to set up the stand 10, the user has only to manually spread the legs 22, 24 thereof to the desired relative angle. (Once the legs 22, 24 have been separated slightly at the bottom ends thereof, a downward pressure on the enabling means 26 will cause a further spread of the bottom ends of the legs, thereby increasing the relative angle.) The height of each support 62, 64 is then adjusted by loosening the set screw knobs 74, moving the supports 62, 64 and their bases 70 to the desired heights, and then retightening the knobs 74. Each support 62, 64 is then adjusted to the desired pivot angle by loosening the set screw knobs 75, pivoting the supports to the desired pivot angles, and then retightening the knobs 75. The height of receiving means 50 is then adjusted by loosening set screw knob 53, pulling the receiving means 50 upwardly to the desired height (by forcibly sliding the arm 52 relative to the enabling means 26) and then retightening the knob 53. The erected stand 10 is then ready to receive an instrument. The base of the instrument is rested on the supports 62, 64, and more particularly the recesses 66 thereof, and the neck 16 is passed through the opening 56 of the grip 54 so that, when released, the neck 16 is supported by the receiving means 50.

To collapse the stand 10.into a storage orientation once the instrument has been removed therefrom, set screw knob 53 is loosened and the receiving means 50 is pushed downwardly through the bracket **34*a* until further downward movement is blocked by the abutment of the receiving means 50 and the bracket 34*a*. The legs 22, 24 are then pushed towards each other until they are in a generally parallel orientation. (If both bases 70 are at the same height, it may first be necessary to relocate one of the bases 70 after loosening its knob 74.) Finally, if necessary, the knobs 75 are loosened and the supports 62, 64 are pivoted so that they do not extend laterally of the legs 22, 24. This results in the stand 10 being in a very compact, collapsed orientation suitable for storage of the stand 10, as illustrated in FIG. 6**.

While the height and the angular orientation of the supports 62, 64 relative to the legs 22, 24 and the height of receiving means 50 have been described and illustrated as fixable (that is, held in place by the adjustable pressure of a set screw knob), and the relative angle formed by the legs 22, 24 has been described and illustrated as unfixed (that is, maintained only by friction), those schooled in the mechanical arts will appreciate that different configurations are possible. For example, the knobs 75 may be dispensed with and the supports 62, 64 allowed to pivot freely or frictionally relative to the bases 70. (Indeed, the supports may even be non-pivotable relative to the bases 70.) Further, means may be provided for fixing the legs 22, 24 at the desired angle, once obtained, by means well known in the art, such as those available under the trade name MPM QUIK-LOK from Music Industries Corp. of Floral Park, N.Y. Again, frictional means (rather than a set screw knob 52*a*) may be provided for fixing the height of the arm 52 relative to the bracket 34*a*.

To summarize, the present invention provides an adjustable portable stand for supporting an elongated instrument by its base in a generally upright orientation. The supports are independently adjustable in height relative to the assembly to compensate for any bilateral asymmetry in the instrument base, and thereby cooperatively maintaining the instrument in a generally upright orientation. Further, the stand protects the instrument in the event that the stand falls forwardly in the direction of the instrument. The stand is easy and inexpensive to manufacture and maintain.

Now that the preferred embodiments of the present invention have been shown and described in detail, various modifications and improvements thereon will be readily apparent to those skilled in the art. Accordingly, the spirit and scope of the present invention is to be construed broadly and in a manner consistent with the appended claims, and not limited by the foregoing specification.

We claim:

1. An adjustable portable stand for supporting an elongated instrument having an instrument base at one end, said stand comprising:

a multi-leg assembly having a front and including at least first and second rigid legs disposed at a relative angle to each other, each of said first and second legs having a longitudinal axis and a free end;

junction means for functionally joining said first and second legs, said junction means being substantially spaced above said free ends of said first and second legs when the stand is in a generally upright position;

first and second supports for supporting the instrument base thereon projecting forward from said first and second legs, respectively, between said free ends thereof and said junction means; and means for independently manually adjusting said first and second supports positionally by sliding each of said first and second supports along the longitudinal axis of said first and second legs, respectively, and for fixing said first and second supports positionally at selected points along said first and second supports, respectively.

2. The stand of claim 1 wherein said junction means additionally includes means for enabling manual variation of said relative angle of said legs between a non-parallel orientation for use of the stand and a parallel orientation for storage of the stand.

3. The stand of claim 1 wherein said supports differ in configuration and dimensions.

4. The stand of claim 1 including means for independently manually pivoting each of said first and second supports in orientation relative to said first and second legs, respectively, about an axis transverse thereto and for fixing said first and second supports in a given orientation relative to said first and second legs, respectively, whereby each of said supports is independently adjustable and fixable both positionally and pivotally.

5. In combination, the stand of claim 4 and an elongated instrument having a bilaterally asymmetrical instrument base at one end, each of said supports being fixed positionally and pivotally such that said supports cooperatively maintain said instrument in a generally upright orientation without lateral tilting due to the bilateral asymmetry of said instrument base.

* * * * *